US005092143A

United States Patent [19]

Rumbles

[11] Patent Number: 5,092,143

[45] Date of Patent: Mar. 3, 1992

[54] LOCKABLE ENCLOSURE HAVING A TAMPER-PROOF LOCKING ASSEMBLY

[76] Inventor: Wayne A. Rumbles, 16526 Cotuit Cir., Huntington Beach, Calif. 92649

[21] Appl. No.: 751,545

[22] Filed: Aug. 29, 1991

[51] Int. Cl.[5] ..... E05B 67/38

[52] U.S. Cl. ..... 70/56; 49/394; 70/212; 70/417; 292/205; 292/DIG. 68

[58] Field of Search ..... 70/54–56, 70/DIG. 43, DIG. 56, DIG. 58, 203, 212, 417; 292/205, 218, DIG. 68; 49/394

[56] References Cited

U.S. PATENT DOCUMENTS

| | | | |
|---|---|---|---|
| 320,239 | 6/1885 | Germond | 292/205 X |
| 416,433 | 12/1889 | Wilson | 70/56 |
| 1,812,334 | 6/1931 | Gloekler | 292/205 |
| 3,334,933 | 8/1967 | Ehlers | 292/148 |
| 3,736,016 | 5/1973 | Garvey et al. | 70/56 X |
| 4,288,134 | 9/1981 | Knaack et al. | 70/56 X |
| 4,615,548 | 10/1986 | McGee | 292/148 X |
| 4,655,487 | 4/1987 | Korn et al. | 70/56 X |
| 4,742,701 | 5/1988 | Scavetto | 70/54 X |
| 4,898,008 | 2/1990 | Eberly | 70/56 |

FOREIGN PATENT DOCUMENTS

| | | | |
|---|---|---|---|
| 783438 | 9/1957 | United Kingdom | 70/161 |

*Primary Examiner*—Lloyd A. Gall
*Attorney, Agent, or Firm*—Gene W. Arant

[57] ABSTRACT

An improved enclosure assembly of the type including an openable enclosure, a locking member movable relative to the enclosure for selectively locking or unlocking it, a keeper mechanism mounted on the enclosure for retaining the locking member in its locked position, and a manually operable lock for selectively locking the locking member in its locked position.

An improved tamper-proof locking assembly is provided which greatly minimizes the danger of unwanted intrusion into the locked enclosure. A guard housing having a single opening is placed about the keeper mechanism. The single opening of the guard housing is made large enough for the insertion of a human hand therein when it is desired to unlock the manually operable lock, but is made too small for insertion of a cutting instrument that could cut apart either the locking member, the keeper mechanism, or the manually operable lock.

5 Claims, 4 Drawing Sheets

LOCKABLE ENCLOSURE HAVING A TAMPER-PROOF LOCKING ASSEMBLY

BACKGROUND OF THE INVENTION

There are many situations in agricultural work and in construction work where it appears necessary to keep electrical controls, electrical equipment, tools, or other valuables in an unguarded and rather unprotected environment. It is conventional practice to utilize a locked metal housing for such purposes. Experience has shown, however, that thievery and vandalism are significant problems. It is not usual for padlocks or other locks to be removed by means of a hack saw or a metal cutter. Hence there exists a need for lockable enclosures that are essentially tamper-proof.

It is therefore the object of the present invention to provide a lockable enclosure which is substantially tamper-proof, yet is inexpensive to manufacture and convenient to use.

SUMMARY OF THE PRESENT INVENTION

The present invention provides an improvement for enclosure assemblies of the type that include an openable enclosure, a locking member movable relative to the enclosure for selectively locking or unlocking it, a keeper mechanism mounted on the enclosure for retaining the locking member in its locked position, and a manually operable lock for selectively locking the locking member in its locked position.

According to the present invention an improved tamper-proof locking assembly is provided, which greatly minimizes the danger of unwanted intrusion into the locked enclosure. A guard housing having a single opening is placed about the keeper mechanism. The single opening of the guard housing is made large enough for the insertion of a human hand therein when it is desired to unlock the manually operable lock, but is made too small for insertion of a cutting instrument that could cut apart either the locking member, the keeper mechanism, or the manually operable lock.

Other features and advantages of the invention will become apparent from the following detailed description.

DRAWING SUMMARY

Figure 1:
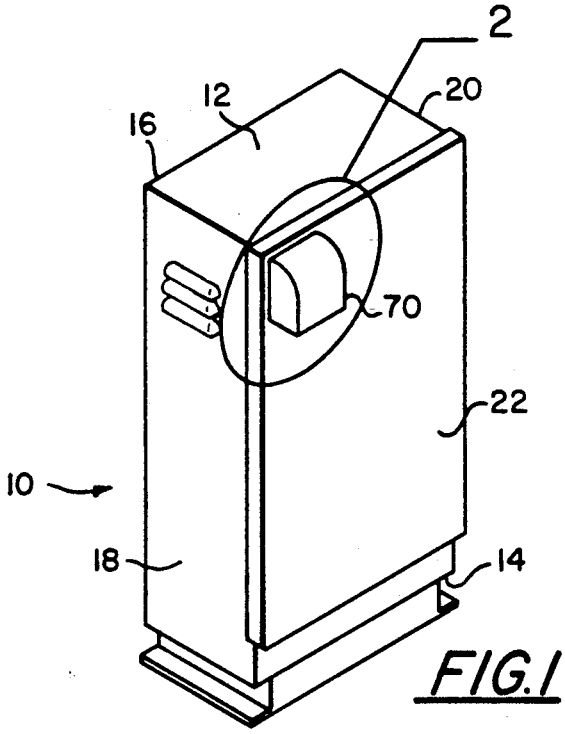
FIG. 1 is a perspective front view of a metal enclosure incorporating the tamper-proof locking assembly of the present invention, when in its closed condition.

FIGS. *6a* and *6b* are fragmentary views showing how the man's hand fits behind the lock actuator after the padlock has been removed; and FIGS. *7a* and *7b* are fragmentary views like FIGS. *6a* and *6b*, showing the opening movement of the lock actuator after the keeper mechanism has been opened.

DETAILED DESCRIPTION

Referring now to the drawings, the illustrated embodiment of the present invention includes an openable metal box 10 having a locking bar 30, a keeper assembly 40 for retaining the locking bar in its locked position, a padlock 60, and a guard housing 70. The guard housing 70 surrounds the keeper assembly 40, the accessible portion of locking bar 30, and the padlock 60. At its lowermost end the guard housing 70 has a single opening 80, which is large enough for the insertion of a human hand therein when it is desired to unlock the padlock, but which is too small for insertion of a cutting instrument that could cut apart either the locking bar 30, the keeper assembly 40, or the padlock 60. It will be noted from FIGS. 2 and 3 that the padlock 60 is adapted to hang vertically, with its lower end being spaced somewhat above the single opening 80.

Metal box 10 has a top wall 12, a bottom wall 14, a rear wall 16, left and right side walls 18 and 20, and an openable front wall 22. As best seen in FIGS. *6b* and *7b*, left side wall 18 has an inwardly turned flange 24 on its forward edge. Left side wall 18 also has another inwardly turned flange 26 which is parallel to the flange 24 but spaced somewhat rearwardly from it. Front wall 22 has an opening 28 through which the locking bar 30 extends in rotatably movable relation to the front wall.

Locking bar 30 has a main vertical section 32 which is located on the inside of front panel 22, and which carries a number of vertically spaced locking tabs 34. At its upper end the bar 30 has a short pivot arm 36, formed as a horizontal section at a right angle to the main vertical section 32, which extends through the panel opening 28. In the same horizontal plane as pivot arm 36 the bar 30 continues into a somewhat longer lever arm 38 which is perpendicular both to main section 32 and pivot arm 36. From the forward end of lever arm 38 a short gripping section 39 extends downwardly, parallel to main bar section 32.

The metal box 10 with its locking bar 30 is of generally conventional construction. As is well known, the lever arm 38 is rotated or pivoted in a horizontal plane towards the front panel 22 in order to rotate the main section 32 of bar 30 about its vertical axis, thus causing the locking tabs or fingers 34 on bar section 32 to move behind and retainingly engage with the locking flange 26 of left wall 18. Structural details showing how the bar 30 is supported for this rotatable movement are well known in the art and are therefore not specifically shown.

Keeper assembly or latch assembly 40 includes a vertical plate 42 of L-shaped cross-section, having a rear section 44 which is welded onto the front side of front panel 22 and a front section 46 which extends perpendicularly outward from the front panel. A horizontal slot 48 in the plate section 46 opens outwardly from the front panel, as best seen in FIG. 3. In the locked condition of the enclosure assembly, as shown in FIGS. 1 through 6, the lever arm portion 38 of locking bar 30 occupies the slot 48. Plate section 46 also has holes or openings 50, 52 formed in its outer extremity, at top and bottom, respectively above and below the slot 48, as best seen in FIGS. 3 and 4.

Keeper assembly or latch assembly 40 also includes a retainer plate or latch plate 54 which is vertically disposed in parallel relation to the plate section 46, its upper end having a rivet 56 which extends through the upper hole 50 of plate 46 to pivotally support the retainer plate thereon. Thus plate 42 is a fixed or stationary part of the keeper assembly while plate 54 is a movable part. See FIGS. 4 and *7a*. When the keeper assembly is in its closed position a hole 58 in the lower end of retainer plate 54 is aligned with the bottom hole 52 of plate section 46, and those aligned holes receive the hasp of padlock 60. See FIGS. 2 and 3.

Padlock 60 has a base or body portion 62 in which the usual parallel recesses are formed. An arcuate hasp 68 has parallel ends 68*a*, 68*b*, which are received in respective ones of those recesses. As is well known, the unlocking of the base of the padlock, whether by key or by combination, results in the release of one end of the hasp 68 so that it can be pulled free of the aligned holes 58, 52.

Guard housing 70 is a trough-like structure preferably made of an impact-resistant metal and having a front wall 72, side walls 74, 76, and a closed upper end 78. The upper end 78 is preferably curved as shown in order to avoid injury to personnel. At the bottom of housing 70 there is the single opening 80. As previously noted, the padlock 60 hangs vertically, with its lower end spaced somewhat above the single opening 80, as seen in FIGS. 2 and 3.

METHOD OF OPERATION

Figure 2:
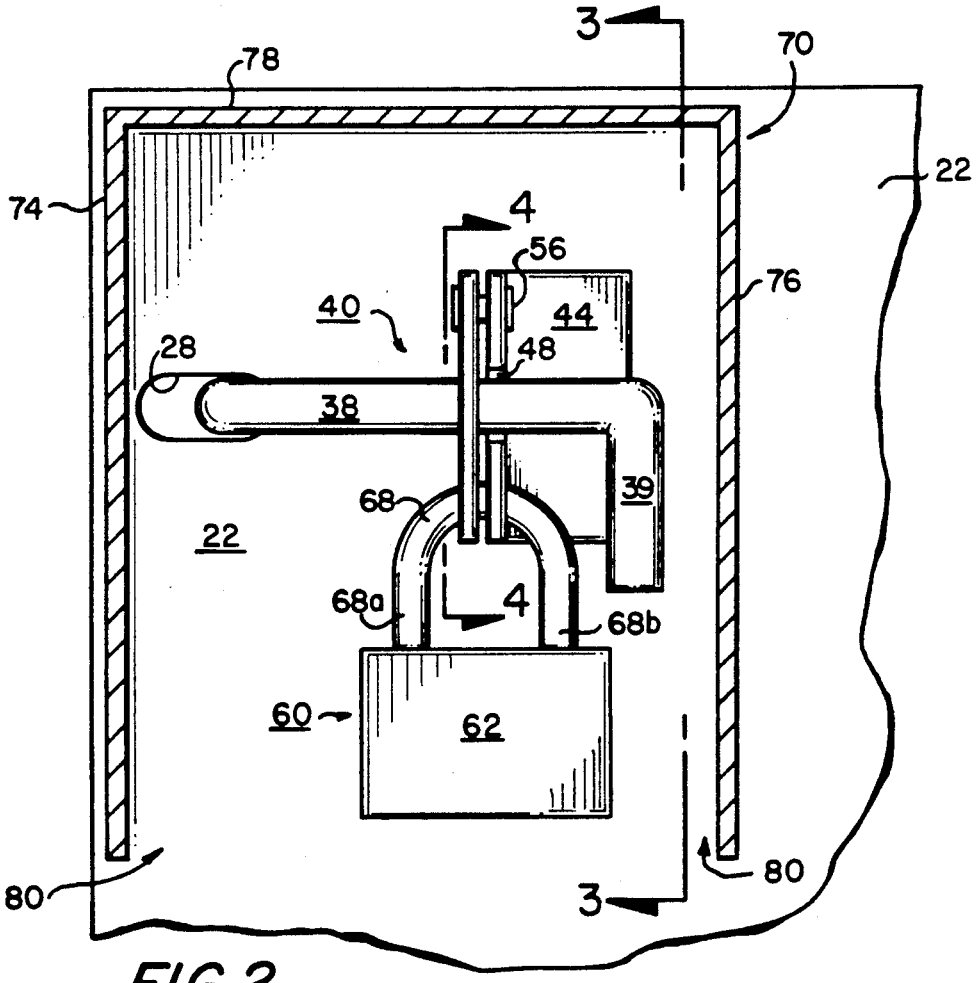
FIG. 2 is an enlarged fragmentary view taken within the circle 2—2 of FIG. 1, showing a front elevation view of the mechanism which locks the enclosure in a locked state, and also showing in cross-section the guard housing which surrounds the mechanism.
Figure 3:
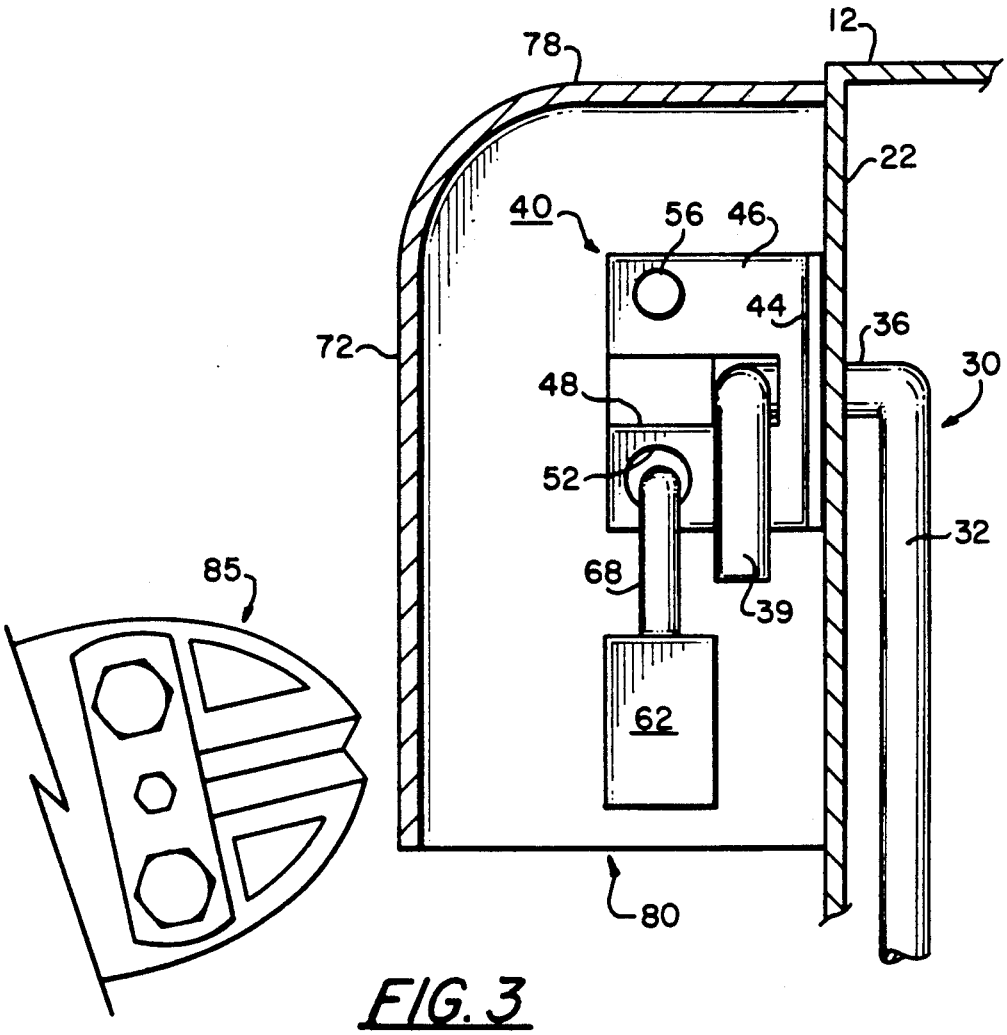
FIG. 3 is a vertical cross-sectional view taken on the line 3—3 of FIG. 2, showing the right side of the lock mechanism in elevation, and the enclosure and guard housing in cross-section.
Figure 4:
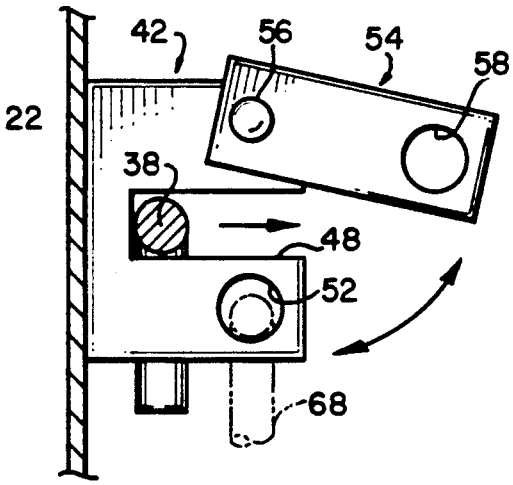
FIG. 4 is a left side elevation view of the lock mechanism, showing the keeper for the lock actuator when raised to its open or released position.

The enclosure assembly will normally be locked, as shown in FIGS. 1-3. If an intruder attempts to break the lock, the means most likely to be used would be a metal bolt cutter 85, such as shown on the left side of FIG. 3. However, opening 80 at the bottom of guard housing 70 is too small relative to the size of the bolt cutter to permit the cutter to be successfully inserted into the housing in such a way as to cut the hasp 68 of padlock 60, or the locking bar or keeper.

It is very important that the housing 70 and its contents be elevated at least about three feet above the bottom of metal box 10. This provides convenient access to users.

Figure 5:
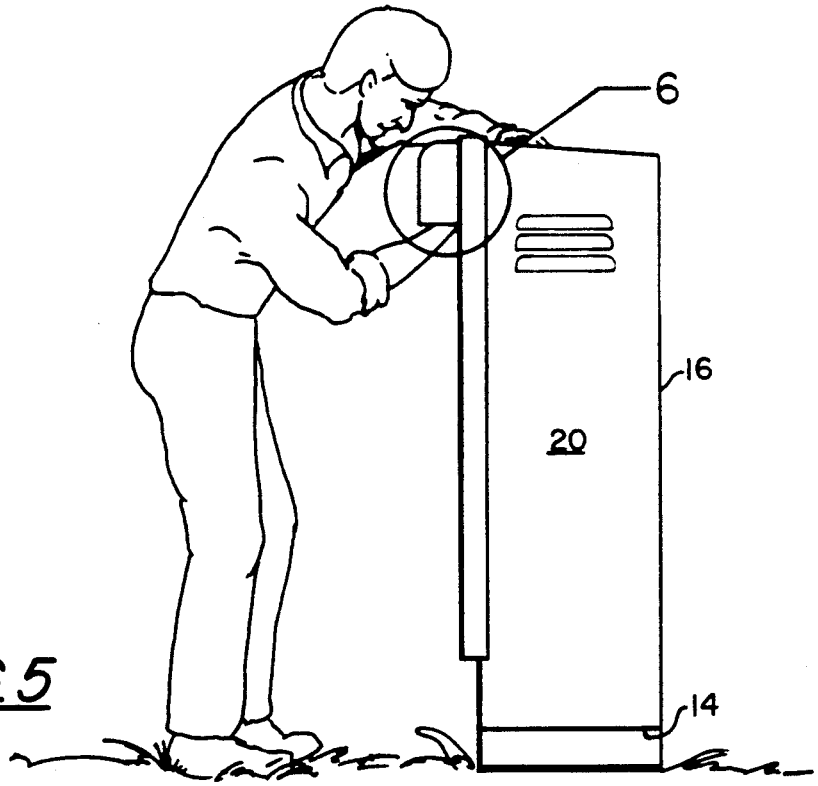
FIG. 5 is a side elevation of the enclosure and guard housing showing the position of a man when preparing to open the enclosure.
Figure 6A:
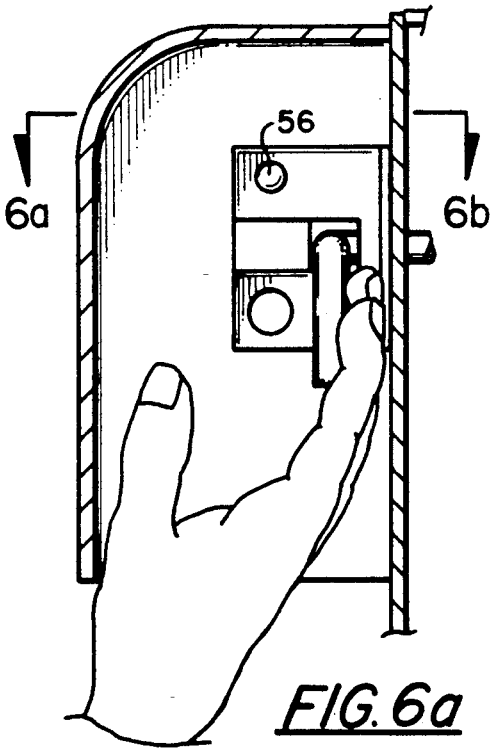
Figure 6B:
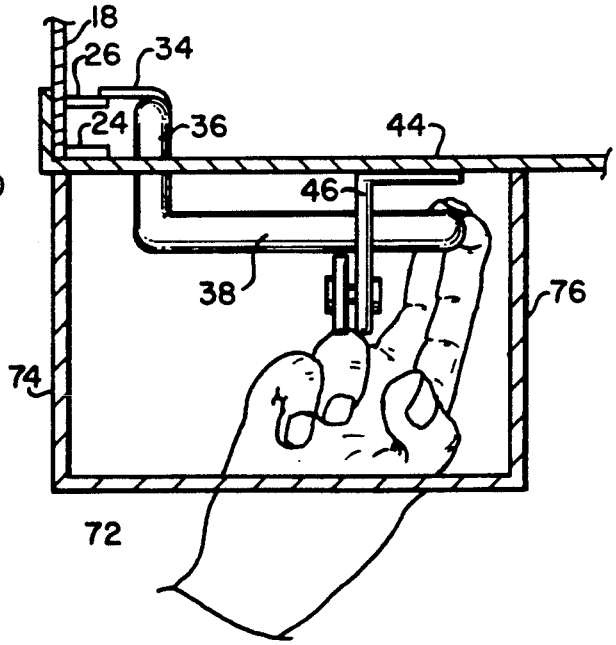
Figure 7A:
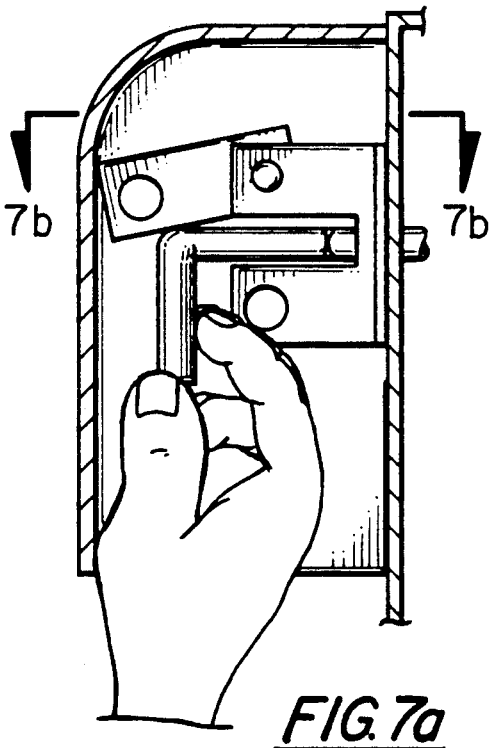
Figure 7B:
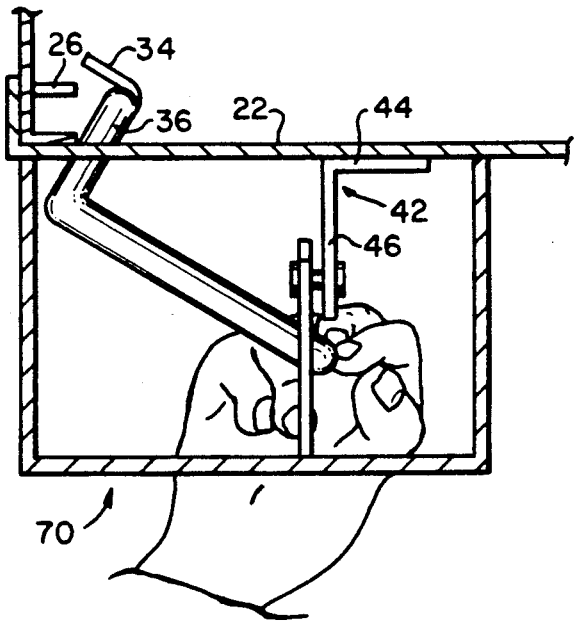

FIG. 5 shows how a man will insert his hand inside the guard housing 70 in order to unlock the padlock, either by key or by combination. FIG. 4 shows the state of the keeper mechanism after the padlock is removed and movable plate 46 is swung to its open position.

FIGS. *6a* and *6b* show how, after removing the padlock, the man will insert his forefingers behind gripping end 39 of the locking bar 30. FIGS. *7a* and *7b* show the next step, when lever arm 38 is pulled away from front panel 22, causing plate 54 to swing upward to its open position, and at the same time causing main section 32 of locking bar 30 to rotate about its vertical axis so that the latching fingers 34 become disengaged from the locking flange 26 of left side wall 18. The door 22 may then be swung open.

Although only the presently preferred embodiment of the invention has been illustrated and described here in detail, it will nevertheless be understood that many variations may be made, which are within the spirit and concept of the invention. Thus the scope of my invention is to be limited only in accordance with the appended claims.

What I claim is:

1. A tamper-proof lockable enclosure assembly which comprises, in combination:

an openable enclosure having a door;

a locking member extending through an opening in said door and having an external portion which is horizontally swingable towards or away from said door for selectively locking or unlocking the enclosure;

a latch assembly fixedly secured to the outer side of said door and including a vertically disposed plate section extending perpendicularly outwardly from said door, and a latch plate vertically disposed in parallel relation to said plate section and having its upper end pivotally secured to the upper end of said plate section;

said plate section having an outwardly opening horizontal slot adapted to receive said external portion of said locking member, and said latch plate being adapted to retain said external portion of said locking member in said slot, the lower ends of said plate section and said latch plate having holes which are normally aligned; and a guard housing fixedly secured to the external surface of said door and surrounding said latch assembly and the external portion of said locking member, said guard housing at its lowermost end having a single opening which is large enough for the insertion of a human hand therein when it is desired to move said external portion of said locking member or to use a padlock for locking said aligned holes, but which is too small for insertion of a cutting instrument that could cut apart either said locking member, said latch assembly, or the padlock.

2. A tamper-proof lockable enclosure assembly as in claim 1 wherein said locking member further includes a short gripping section extending downwardly within said housing and parallel to said latch plate for convenient hand access when it is desired to open or close the enclosure.

3. A tamper-proof lockable enclosure assembly as in claim 1 wherein said locking member is a vertical locking bar having a main section thereof rotatably mounted on the inner side of said door, said locking bar at an upper end of its main section being bent at a right angle to form a short pivot arm as a horizontal section which extends through said opening in said door, and being further bent at a right angle in the same horizontal plane to form a lever arm which is perpendicular both to said main section and to said pivot arm, said lever arm being disposed on the outer side of said door and swingable towards or away from said door for rotating said locking bar main section;

said locking member further including a short gripping section extending downwardly within said housing and parallel to said latch plate for convenient hand access when it is desired to open or close the enclosure.

4. An improved enclosure assembly of the type that includes an openable enclosure, a locking member movable relative to the enclosure for selectively locking or unlocking it, a latch assembly mounted on the enclosure for retaining the locking member in its locked position, and a manually operable lock for selectively locking the latch mechanism so as to secure the locking member in its locked position, characterized by:

the enclosure having a fixed wall, and a horizontally swingable door having an edge which engages the fixed wall for closing the enclosure, said fixed wall having an inwardly turned flange thereon;

said locking member including a vertical locking bar having a main section thereof rotatably mounted on the inner side of said door adjacent said edge thereof, said locking bar main section carrying at least one locking tab adapted to lockingly engage said flange when said locking bar is rotated;

said door having an opening therein adjacent an upper end of said locking bar;

said locking bar at the upper end of its main section being bent at a right angle to form a short pivot arm as a horizontal section which extends through said opening in said door, and being further bent at aright angle in the same horizontal plane to form a lever arm which is perpendicular both to said main section and to said pivot arm, said lever arm being disposed on the outer side of said door and swingable towards or away from said door for rotating said locking bar main section;

said latch assembly fixedly secured to the outer side of said door and including a plate section extending perpendicularly outwardly from said door, said plate section having an outwardly opening horizontal slot which, in the locked condition of the enclosure assembly, receives said lever arm of said locking bar;

said latch assembly further including a latch plate vertically disposed in parallel relation to said plate section, said latch plate having an upper end pivotally secured to the upper end of said plate section and being adapted to retain said lever arm of said locking bar in said slot, the lower ends of said plate section and said latch plate having holes which are normally aligned; and a guard housing fixedly secured to the external surface of said door and surrounding said latch assembly and the accessible portion of said locking bar, said guard housing at its lowermost end having a single opening which is large enough for the insertion of a human hand therein when it is desired to actuate said lever arm or to use a padlock for locking said aligned holes, but which is too small for insertion of a cutting instrument that could cut apart either said locking bar, said latch assembly, or the padlock.

5. The lockable enclosure assembly of claim 4 wherein said locking bar further includes a short gripping section extending from the end of said lever arm downwardly within said housing and parallel to said main section of said locking bar, for convenient hand access when it is desired to open the enclosure.

* * * * *